US009682548B2

(12) United States Patent
Ohnishi

(10) Patent No.: US 9,682,548 B2
(45) Date of Patent: Jun. 20, 2017

(54) PRINT DEVICE AND PRINT METHOD

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/585,156

(22) Filed: Dec. 29, 2014

(65) Prior Publication Data

US 2015/0191008 A1 Jul. 9, 2015

(30) Foreign Application Priority Data

Jan. 8, 2014 (JP) ..... 2014-001427

(51) Int. Cl.
*B41J 2/045* (2006.01)

(52) U.S. Cl.
CPC ..... *B41J 2/04581* (2013.01); *B41J 2/04588* (2013.01); *B41J 2/04596* (2013.01)

(58) Field of Classification Search
CPC ..... B41J 2/04588
See application file for complete search history.

(56) References Cited

U.S. PATENT DOCUMENTS 4,369,455 A * 1/1983 McConica ..... B41J 2/04581 347/11
4,393,384 A * 7/1983 Kyser ..... B41J 2/2128 347/94
4,972,211 A * 11/1990 Aoki ..... 347/11
6,186,610 B1 * 2/2001 Kocher et al. ..... 347/11
6,513,894 B1 * 2/2003 Chen et al. ..... 347/11
2005/0088468 A1 * 4/2005 Clark ..... 347/11
2013/0063508 A1 * 3/2013 Norigoe ..... B41J 2/04588 347/11

FOREIGN PATENT DOCUMENTS

JP 2009-113426 5/2009

OTHER PUBLICATIONS

Machine generated English translation of JP2009-113426 "Liquid Jetting Device" to Yamashita Noriaki; translation obtained via https://www4.j-platpat.inpit.go.jp/eng/tokujitsu/tkbs_en/TKBS_EN_GM101_Top.action on Jun. 15, 2015; 28 pp.*
"First Office Action of China Counterpart Application", issued on Dec. 18, 2015, pp. 1-16, with English translation thereof.

* cited by examiner

*Primary Examiner* — Shelby Fidler
(74) *Attorney, Agent, or Firm* — Jianq Chyun IP Office

(57) ABSTRACT

A print device is configured to perform printing by an ink jet scheme including: an ink jet head including a nozzle, an ink chamber that stores ink droplets at an upstream of the nozzle, and a piezoelectric element; and a drive signal output section that outputs a drive signal for causing the piezoelectric element to be displaced. The drive signal includes a discharge driving signal for causing the piezoelectric element displaced so that ink droplets are discharged from the nozzle, and a post-discharge controlling signal for causing the piezoelectric element displaced after the ink droplets are discharged from the nozzle, the drive signal output section outputs the discharge driving signal by which a voltage changes linearly from a first voltage to a second voltage which are predeterminedly set, at a timing when the ink droplets are to be discharged from the nozzle, and outputs a substantial sine wave.

3 Claims, 6 Drawing Sheets

PRINT DEVICE AND PRINT METHOD

CROSS-REFERENCE TO RELATED APPLICATION

This application claims the priority benefit of Japan application serial no. 2014-001427, filed on Jan. 8, 2014. The entirety of the above-mentioned patent application is hereby incorporated by reference herein and made a part of specification.

BACKGROUND OF THE INVENTION (1) Field of the Invention

The present invention relates to a print device and a print method.

(2) Description of Related Art

In the recent years, an ink jet printer that performs printing by an ink jet scheme is widely used. In the ink jet printer, ink droplets are discharged from a nozzle by driving a drive element (piezoelectric element and the like) provided at a position of the nozzle of the ink jet head. In this case, as a drive signal for driving the drive element, for example, a trapezoidal wave and the like is widely used. Further, conventionally, a configuration that uses a drive signal (potential signal) configured of plural types of sine waves with different cycles is known (for example, see JP-A2009-113426).

SUMMARY OF THE INVENTION

In the configuration of JP-A2009-113426, for a case of using a drive signal formed of a trapezoidal wave, a drive signal formed of plural types of sine waves with different cycles is used due to a risk that an unintended vibration (deformation) may occur in the drive signal or in a pressure chamber. However, in the recent years, due to the increase in the print accuracy as required, a configuration that can discharge ink droplets with higher accuracy is being required as the configuration for discharging the ink droplets from the nozzle of the ink jet head. Thus, an object of the invention is to provide a print device and a print method that can solve the above problem.

The inventor of the present application has conducted detailed study on a drive signal for driving a piezoelectric element in a case of using the piezoelectric element as a drive element to be used for discharging ink droplets from a nozzle. Then, firstly, the inventor considered using as the drive signal a discharge driving signal that causes the piezoelectric element to be displaced so as to discharge ink droplets from a nozzle, and a post-discharge controlling signal for suppressing vibration of a meniscus of ink (meniscus vibration) that is generated after the discharge. Further, by an in-depth detailed study, it has been found that a use of a signal of which voltage changes linearly as the discharge driving signal, and a use of a signal of a substantial sine wave as the post-discharge controlling signal are preferable. To solve the above problem, the present invention is provided with the following configurations.

(Configuration 1) A print device is configured to perform printing by an ink jet scheme, the print device including: an ink jet head including a nozzle that discharges ink droplets, an ink chamber that stores ink droplets at an upstream of the nozzle, and a piezoelectric element that causes ink in the ink chamber to be discharged from the nozzle; and a drive signal output section that outputs a drive signal being a signal for causing the piezoelectric element to be displaced. The drive signal is a signal that includes a discharge driving signal for causing the piezoelectric element to be displaced so that an ink droplet is discharged from the nozzle, and a post-discharge controlling signal for causing the piezoelectric element to be displaced after the ink droplet was discharged from the nozzle, the drive signal output section is configured to: output, as the discharge driving signal, a signal by which a voltage changes linearly from a first voltage to a second voltage, which were predetermined set, at a timing when the ink droplet is to be discharged from the nozzle, and output, as the post-discharge controlling signal, a signal of a substantial sine wave.

To cause the ink droplets to strike onto a medium with high accuracy (striking position accuracy) in an ink jet printer, a discharging speed by which the ink droplets are discharged from the nozzle needs to be made sufficiently fast. Further, to obtain this, it becomes necessary to quickly displace the piezoelectric element at the timing when the ink droplets are discharged from the nozzle.

With respect to this, in the case of configuring as above, the piezoelectric element can quickly and appropriately be displaced at the timing when the ink droplets are discharged from the nozzle by using the signal by which the voltage changes linearly as the discharge driving signal. Further, due to this, for example, the discharging speed of the ink droplets can be made optimized and sufficiently fast.

Further, in the case of configuring as above, by using the post-discharge controlling signal, for example, the meniscus vibration of the ink generated after the discharge can be suppressed appropriately. Due to this, for example, an influence of the meniscus vibration generated upon each occasion of the discharge of the ink droplets can appropriately be prevented from being imposed on a discharge operation of the ink droplets taking place thereafter. Further, in this case, since it becomes possible to shorten time needed before the meniscus vibration is settled, a discharge interval of the ink droplets can be made shorter. In this case, being able to shorten the discharge interval of the ink droplets means, more specifically, for example, that the discharge interval can be shortened without reducing printing quality. Further, due to this, for example, since a moving speed of the ink jet head upon a main scan operation (scan operation) can be made fast, even faster printing can be performed. Further, for example, by suppressing the meniscus vibration, generation of ink mist and the like can appropriately be suppressed.

Moreover, in the case of configuring as above, by using the signal of a substantial sine wave as the post-discharge controlling signal, for example, an abrupt displacement of the piezoelectric element upon suppression of the meniscus vibration can be prevented. Due to this, for example, an unintended vibration and the like being generated can be prevented, while the meniscus vibration can more appropriately be suppressed.

Due to this, by configuring as above, for example, the piezoelectric element can be driven more appropriately for both upon discharging the ink droplets from the nozzle and upon controlling the meniscus vibration thereafter. Further, due to this, for example, the ink droplets can be discharged more appropriately with even higher accuracy from the nozzle of the ink jet head.

Note that, the voltage changing linearly in connection to the discharge driving signal means that the voltage changes linearly relative to time. Further, the timing when the ink droplets are discharged from the nozzle means a time period during which the piezoelectric element is to be displaced for discharging ink droplets, for example. More specifically, this timing may be a timing and the like that increases a pressure in the ink chamber just before the discharge. Further, being a substantial sine wave in connection to the post-discharge controlling signal means for example, being substantially a sine wave in accordance with the accuracy and the like of a passage for transmitting the post-discharge controlling signal. Further, the drive signal output section for example generates the post-discharge controlling signal based on a natural frequency of the meniscus vibration. Further, the drive signal output section may generate the post-discharge controlling signal based on a variable frequency of the ink pressure in the ink jet head. By configuring as above, for example, the ink vibration generated upon the discharge can be suppressed appropriately.

(Configuration 2) The discharge driving signal is a signal in a rectangular wave form, a trapezoidal wave form, or a sawtooth wave form. By configuring as above, for example, the piezoelectric element can be displaced more appropriately at the timing when the ink droplets are discharged from the nozzle.

(Configuration 3) The drive signal output section is configured to output, as the post-discharge controlling signal, a signal for causing the piezoelectric element to be displaced in a direction along which a meniscus vibration in which a liquid surface of the ink vibrates at a position of the nozzle after the ink droplet was discharged is suppressed. By configuring as above, for example, the meniscus vibration can be suppressed more appropriately after the discharge of the ink droplets.

(Configuration 4) The drive signal output section is configured to output, as the post-discharge controlling signal, the signal for causing the piezoelectric element to be displaced so that the liquid surface is moved to a direction opposite a movement of the liquid surface of the ink in the meniscus vibration. By configuring as above, for example, the meniscus vibration can be suppressed more appropriately after the discharge of the ink droplets.

(Configuration 5) The drive signal output section is configured to output, as the post-discharge controlling signal, a signal of a substantial sine wave having a same frequency as the meniscus vibration. By configuring as above, for example, the meniscus vibration can be suppressed more appropriately after the discharge of the ink droplets.

(Configuration 6) The drive signal output section is configured to output a signal of a complex wave in which a sine wave with a different frequency from the post-discharge controlling signal and the post-discharge controlling signal are superposed, at a timing after the ink droplets are discharged from the nozzle. By configuring as above, for example, the meniscus vibration can be suppressed more appropriately after the discharge of the ink droplets. Note that, as such a complex wave, for example, a signal of a complex wave that takes into consideration even a vibration mode of the meniscus vibration in a higher degree and the like may be used.

(Configuration 7) In a case of denoting a timing when the ink droplet is discharged from the nozzle as a timing To, and denoting a cycle of a natural vibration of a meniscus vibration in which a liquid surface of the ink vibrates at a position of the nozzle after the ink droplets are discharged as Tc, the drive signal output section is configured to output the post-discharge controlling signal at least after the timing To and at least partially during a period until a time Tc/4 is elapsed. By configuring as above, for example, the meniscus vibration can be suppressed more appropriately after the discharge of the ink droplets.

Note that, the drive signal output section preferably outputs the post-discharge controlling signal at the same time as the timing To, or from immediately after the timing To. Further, the drive signal output section preferably outputs the post-discharge controlling signal at least in a period until Tc/4 from the timing To. For example, the drive signal output section may output the post-discharge controlling signal at the same time as the timing To, or from immediately after the timing To during the period until Tc/4 from the timing To.

(Configuration 8) A print method is configured to perform printing by an ink jet scheme, the print method including: outputting a drive signal being a signal for causing a piezoelectric element to be displaced to an ink jet head including a nozzle that discharges ink droplets, an ink chamber that stores ink droplets at an upstream of the nozzle, and the piezoelectric element that causes ink in the ink chamber to be discharged from the nozzle. The drive signal is a signal that includes a discharge driving signal for causing the piezoelectric element to be displaced so that an ink droplet is discharged from the nozzle, and a post-discharge controlling signal for causing the piezoelectric element to be displaced after the ink droplet was discharged from the nozzle; outputting, as the discharge driving signal, a signal by which a voltage changes linearly from a first voltage to a second voltage, which were predetermined set, at a timing when the ink droplet is to be discharged from the nozzle; and outputting, as the post-discharge controlling signal, a signal of a substantial sine wave. By configuring as above, for example, an effect similar to Configuration 1 can be achieved.

According to the present invention, for example, ink droplets can be discharged more appropriately from the nozzle of the ink jet head with even higher accuracy.

BRIEF DESCRIPTION OF THE DRAWINGS

FIG. 1A and FIG. 1B are a front diagram and a top diagram showing an example of a configuration of a primary part of the print device 10 according to an embodiment of the present invention.

FIG. 2A and FIG. 2B are diagrams showing an example of an even more detailed configuration of ink jet heads 12, wherein FIG. 2A is a diagram showing an example of the configuration of the ink jet heads 12 and FIG. 2B is a diagram showing an example of a configuration for discharging ink droplets from nozzles 202.

DETAILED DESCRIPTION OF PREFERRED EMBODIMENTS

Figure 1A:
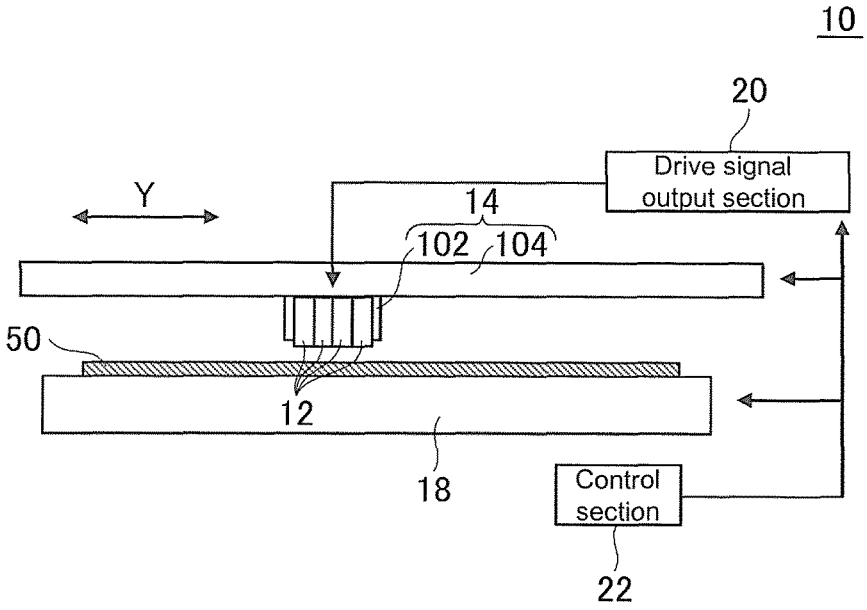
FIG. 1A and FIG. 1B are diagrams showing an example of a print device 10 according to an embodiment of the present invention.
Figure 1B:
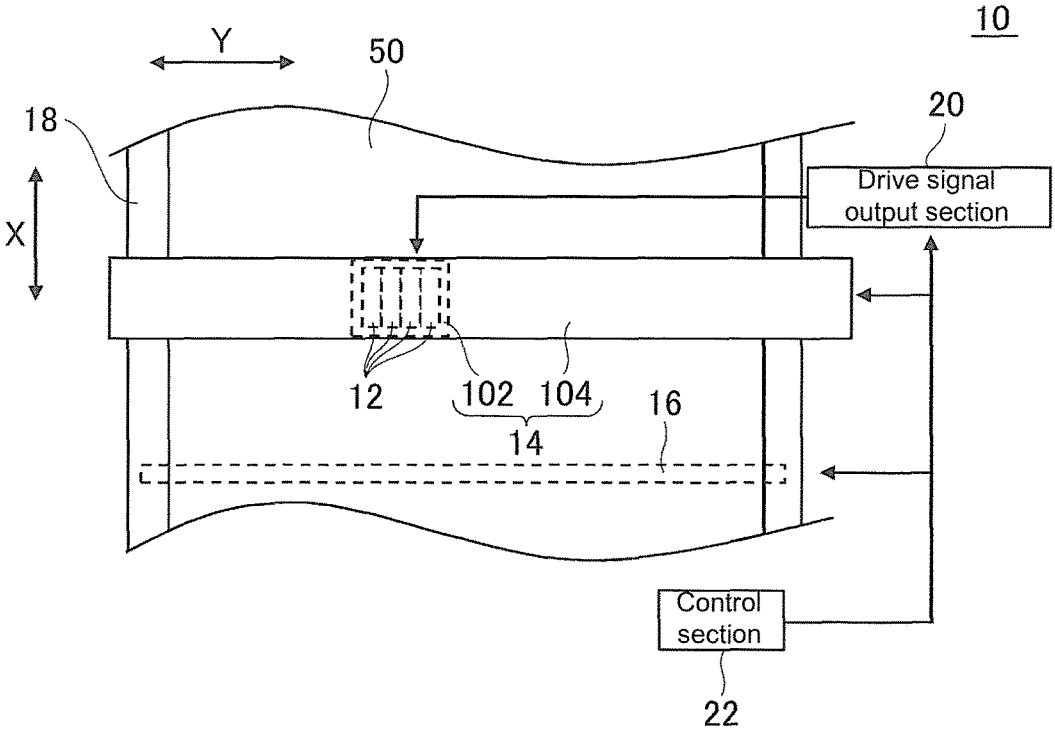

Herein below, embodiments of the present invention will be described with reference to the drawings. FIG. 1A and FIG. 1B show an example of a print device 10 according to an embodiment of the present invention. FIG. 1A and FIG.

1B are a front diagram and a top diagram showing the example of a configuration of a primary part of the print device 10.

In this example, the print device 10 is an ink jet printer that performs printing by an ink jet scheme, and includes a plurality of ink jet heads 12, a main scan driving section 14, a sub scan driving section 16, a platen 18, a drive signal output section 20, and a control section 22.

The plurality of ink jet heads 12 is ink jet heads that each discharge ink droplets of respective colors used in printing. In this example, the plurality of ink jet heads 12 is arranged to align in a main scanning direction that is predetermined set (Y direction in the drawings). Further, each of the ink jet heads 12 has nozzles for discharging the ink droplets, and discharges the ink droplets from the nozzles in accordance with a drive signal received from the drive signal output section 20.

Note that, in this example, the print device 10 is provided for example with the plurality of ink jet heads 12 that discharge the ink droplets of respective colors of CMYK. The print device 10 may further be provided with the ink jet heads 12 for discharging the ink droplets of colors other than CMYK. Further, as for a more detailed configuration of the ink jet heads 12, a detailed description will be given later.

The main scan driving section 14 is configured to cause the plurality of ink jet heads 12 perform a main scan operation of discharging the ink droplets while moving in the main scanning direction. In this example, the main scan driving section 14 includes a carriage 102 and a guide rail 104. The carriage 102 retains the plurality of ink jet heads 12 in a state where the nozzles of the respective ink jet heads 12 and a medium 50 are facing each other. The guide rail 104 is a rail for guiding the movement of the carriage 102 in the main scanning direction, and moves the carriage 102 in the main scanning direction in accordance with an instruction from the control section 22.

The sub scan driving section 16 is configured to cause the plurality of ink jet heads 12 perform a sub scan operation of relatively moving in a sub scanning direction (X direction in the drawings) that perpendicularly intersects with the main scanning direction relative to the medium 50. In this example, the sub scan driving section 16 is a roller for transferring the medium 50, and causes the plurality of ink jet heads 12 perform the sub scan operation by transferring the medium 50 between main scan operations.

Note that, as a configuration of the print device 10, for example, a configuration (for example, X-Y table type apparatus) that performs the sub scan operation by moving the ink jet head 12 side relative to the medium 50 with a fixed position without performing the transfer of the medium 50 may be considered. In this case, as the sub scan driving section 16, for example, a driving section and the like can be used for moving the ink jet heads 12 by moving the guide rail 104 in the sub scanning direction.

The platen 18 is a table member for mounting the medium 50, and supports the medium 50 by having it face the plurality of ink jet heads 12. The drive signal output section 20 is a signal output section for outputting a drive signal to the plurality of ink jet heads 12, and for example outputs the drive signal to the plurality of ink jet heads 12 in accordance with an instruction of the control section 22.

Note that, in this example, the drive signal is a signal for causing piezoelectric elements to be displaced in the ink jet heads 12. Further, the drive signal output section 20 for example selects some nozzles from the plurality of nozzles provided in each of the plurality of ink jet heads 12 according to an image to be printed at each timing upon the main scan operation, and supplies the drive signal to the piezoelectric elements corresponding to the selected nozzles. By configuring as above, for example, a desired image can appropriately be printed by the plurality of ink jet heads 12. Further, the drive signal will be described later in greater detail.

The control section 22 for example is a CPU of the print device 10, and controls operations of respective sections of the print device 10 for example in accordance with instructions of a host PC. According to the above configuration, the print device 10 performs printing on the medium 50.

Note that, as for points other than those described above and herein below, the print device 10 may have a configuration identical to or similar to a known ink jet printer. For example, the print device 10 may further be provided with a configuration for fixing ink on the medium 50 depending on types of ink to be used. More specifically, for example, as with ultraviolet curing ink, solvent UV ink and the like, in a case of using ink that cures by irradiation of ultraviolet ray, the print device 10 may further be provided with an ultraviolet light source (for example, UV LED and the like). Further, in a case of using ink of which solvent needs to be evaporated (for example, solvent ink, latex ink, solvent UV ink, aqueous ink and the like), the print device 10 may further be provided with a heater and the like for heating the medium 50.

Figure 2A:
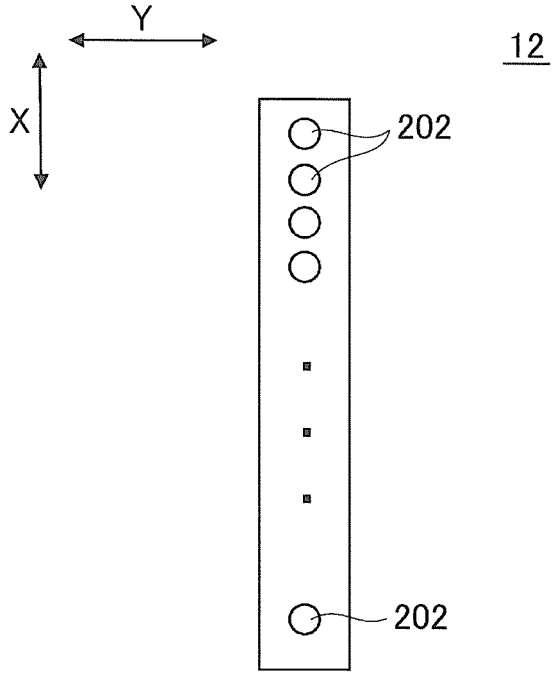
Figure 2B:
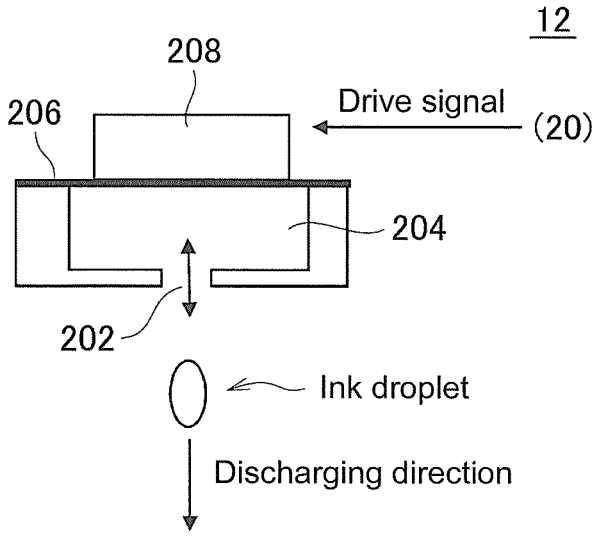

Next, a more detailed configuration of the ink jet heads 12 will be described. FIG. 2A and FIG. 2B show a more detailed configuration of the ink jet heads 12. FIG. 2A is a diagram showing an example of the configuration of the ink jet heads 12, and shows an example in which an ink jet head 12 is seen from a nozzle surface side where a plurality of nozzles 202 is funned. The ink jet head 12 shown in FIG. 2A is one ink jet head 12 among the plurality of ink jet heads 12 provided in the print device 10. FIG. 2B is a diagram showing an example of a configuration for discharging ink droplets from a nozzle 202, and shows an example of a configuration around each nozzle 202 in the ink jet head 12.

In this example, the ink jet heads 12 have nozzle rows in which the plurality of nozzles 202 is aligned in the sub scanning direction (X direction), and ink droplets of the same color are discharged from the plurality of nozzles 202 of each nozzle row. The ink jet head 12 may for example include a plurality of nozzle rows. In this case, the ink jet head 12 may discharge ink droplets of the same color from the nozzles 202 in the plurality of nozzle rows.

Further, as shown in FIG. 2B, the ink jet head 12 further includes an ink chamber 204, a thin film 206, and a piezoelectric element 208 at a position of each nozzle 202 in the nozzle row. Note that, in the ink jet head 12, configurations of the nozzles 202, the ink chambers 204, the thin films 206, and the piezoelectric elements 208 may for example be identical to or similar to a corresponding configuration of a known ink jet printer.

The ink chamber 204 is a space for storing ink droplets at an upstream of the nozzle 202, and supplies the ink discharged as ink droplets to the nozzle 202. In this example, the ink chamber 204 has the hole-shaped nozzle 202 formed at a bottom surface portion, and is configured by a cavity of which surface facing the bottom surface is opened. Further, although depiction is omitted, the ink chamber 204 is connected for example to an ink tank or an ink cartridge via an ink passage. Due to this, when the ink in the ink chamber 204 decreases, ink is sequentially supplied from the ink tank or ink cartridge and the like to the ink chamber 204.

The thin film 206 is an elastic film covering the opening of the ink chamber 204. Further, in this example, the thin film 206 is in contact with the piezoelectric element 208 by a surface on an opposite side of the ink chamber 204. Due to this, the thin film 206 transmits a displacement of the piezoelectric element 208 to the ink chamber 204, so as to cause the ink chamber 204 to function as a pressurizing chamber for applying pressure for discharging ink droplets to the nozzle 202.

The piezoelectric element 208 is a drive element for discharging the ink in the ink chamber from the nozzle, and causes the pressure in the ink chamber 204 to change via the thin film 206 by being displaced in accordance with the drive signal received from the drive signal output section 20. Further, due to this, the piezoelectric element 208 discharges ink droplets from the nozzle 202. According to this example, for example, the ink droplets can appropriately be discharged from the plurality of nozzles 202 in the ink jet head 12. Further, due to this, printing can be performed appropriately on the medium.

Figure 3:
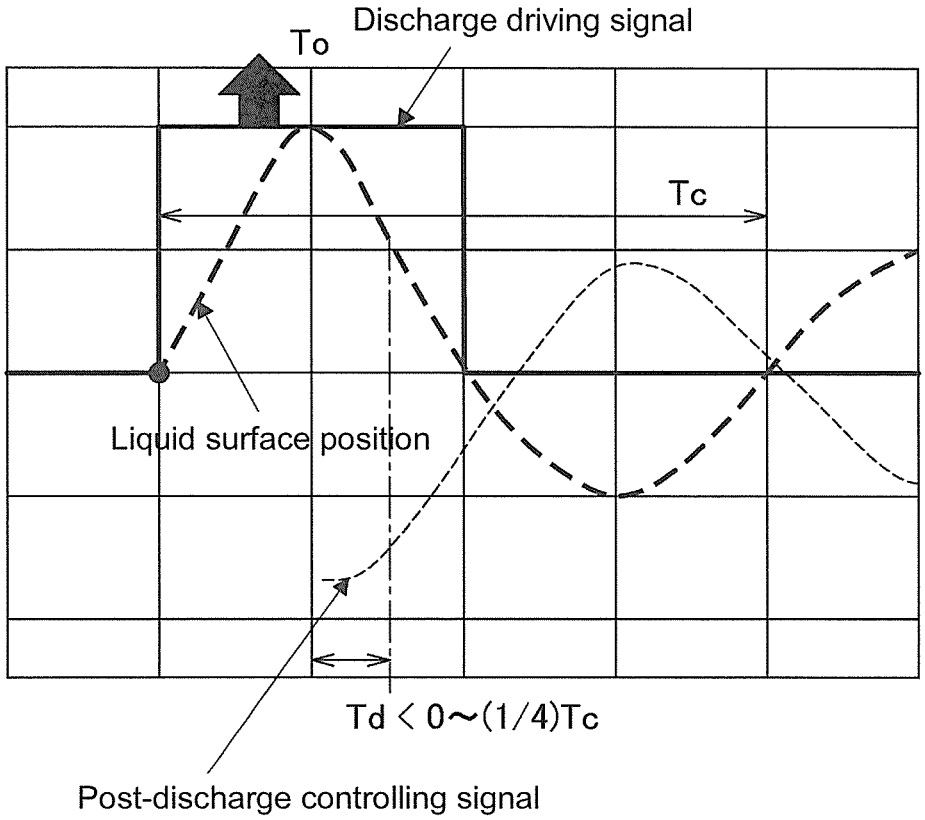
FIG. 3 is a graph showing an example of a drive signal used in the example.

Next, in this example, the drive signal that the drive signal output section 20 outputs will be described in further detail. FIG. 3 is a graph showing an example of a drive signal used in the example. Note that, in the graph of FIG. 3, a curved line shown as a liquid surface position indicate a position of a liquid surface of meniscus of ink formed at a position of the nozzle 202. As can be understood from the graph, the liquid surface position of the ink is displaced in accordance with the drive signal. Further, due to this, meniscus vibration is generated at the position of the nozzle after the discharge of the ink droplets.

In this example, the drive signal output section 20 outputs a signal including a discharge driving signal and a post-discharge controlling signal as the drive signal. In this case, the discharge driving signal is a signal for displacing the piezoelectric element 208 so that an ink droplet is discharged from the nozzle 202. Further, the post-discharge controlling signal is a signal for suppressing liquid surface vibration of the ink after the discharge, and displaces the piezoelectric element 208 after when the ink droplet is discharged from the nozzle 202. The post-discharge controlling signal may be a signal for noise cancellation (noise canceller) for suppressing liquid surface vibration, which becomes a noise in a printing operation.

Further, in this example, the drive signal output section 20 outputs a signal by which voltage changes linearly from a first voltage to a second voltage that were predetermined set, as the discharge driving signal at a time period when the ink droplets are to be discharged from the nozzles 202. In this case, the time period when the ink droplets are to be discharged from the nozzles 202 refers to a time period for displacing the piezoelectric elements 208 to discharge the ink droplets, for example. More specifically, this time period may be a time period and the like that increases a pressure in the ink chamber just before the discharge. Further, the time period for displacing the piezoelectric elements 208 to discharge ink droplets may for example be a time period including a time period for drawing ink into the ink chambers 204 just before the discharge, and a time period for applying pressure to the ink chambers 204 thereafter. Further, as to the discharge driving signal, the voltage changing linearly may refer to substantially changing the voltage linearly in accordance with an accuracy and the like of a passage for transmitting the discharge driving signal, for example. The signal by which the voltage changes substantially linearly refers to a signal outputted so that the voltage changes linearly, for example by a circuit design.

More specifically, in the graph of FIG. 3, an example for a case of outputting the discharge driving signal of a rectangular wave is shown. In other examples, the drive signal output section 20 may output signals for example having a rectangular wave form, a trapezoidal wave form, or a sawtooth wave form.

Note that, in the graph of FIG. 3, a horizontal axis is a time axis. Further, in connection to waveforms of the discharge driving signal and the post-discharge controlling signal, a vertical axis shows a signal voltage. In this case, a voltage change toward an upper side of the graph is a voltage change that causes the piezoelectric elements to be displaced to apply pressure to the ink chambers 204. Further, in connection to a waveform at the liquid surface position, the vertical axis shows a position of the meniscus liquid surface. In this case, a direction as shown by an arrow in the graph is a direction from the nozzles 202 towards the medium 50. Further, such a relationship applies similarly to FIGS. 4 to 6 to be described herein below.

In the case of the example shown in FIG. 3, in a time period when the voltage of the discharge driving signal is high in the graph, the piezoelectric elements 208 are displaced to apply pressure to the ink chambers 204. Further, the ink in the ink chambers 204 is pushed out from the nozzles 202 according to the increase in the pressure within the ink chambers 204 by the displacement of the piezoelectric element 208. Due to this, the liquid surface of the meniscus in the ink is pushed out in the direction of the arrow in the drawing.

Further, in this case, parts of the ink pushed out from the nozzles 202 by the force of displacement of the liquid surface of the meniscus are cut off, and fly toward the medium 50 by forming the ink droplets. Due to this, according to the present example, for example, the ink droplets can appropriately be discharged from the nozzles 202 by a pushing method that pushes out the ink by the drive signal.

Further, as shown in the graph, the voltage of the discharge driving signal drops after the discharge of the ink droplets. Due to this, the ink that was being pushed out from the nozzles 202 receives a force in a direction returning into the ink chambers 204. Further, due to this, the position of the liquid surface of the meniscus moves in a direction opposite to the direction shown by the arrow.

Further, as can be understood from the graph, how the position of the liquid surface of the meniscus is changed according to the change in the discharge driving signal is subjected to an influence of a force of inertia and the like as received by the ink. Due to this, when the discharge driving signal is changed, the liquid surface of the meniscus keeps moving even after when the voltage change in the discharge driving signal has ended. As a result, as shown in the graph, the liquid surface of the meniscus continues to vibrate at a cycle (natural vibration cycle) Tc of a predetermined natural vibration for a while. Due to this, meniscus vibration in which the liquid surface of the ink vibrates is generated at the position of the nozzles 202 after the ink droplets were discharged.

Note that, the natural vibration cycle Tc is a cycle of the natural vibration of the ink chambers 204 and the like being the pressure chamber, and for example is determined in accordance with a shape of the ink chambers 204, a size of the nozzles 202, and the like. Further, more specifically, the natural vibration cycle Tc is for example a resonant cycle determined in accordance with a volume V of the ink chambers 204, and a cross sectional area S of the nozzles 202.

Here, in this example, the ink jet head 12 repeatedly discharge the ink droplets from one nozzle 202 in the main scan operation. Due to this, the drive signal output section 20 outputs the drive signal to the piezoelectric element 208 for each occasion of the timing for performing the ink droplet discharge.

However, in this case, at the timing for discharging the ink droplets in each occasion, an influence may be imposed on the accuracy and the like of the discharge if the meniscus vibration generated upon the previous discharge is remaining. Further, for example, a state of the liquid surface of the meniscus upon the discharge is disturbed, and there also is a risk that mist and the like is generated more easily. Due to this, as to the meniscus vibration generated upon the previous discharge desirably has its amplitude suppressed sufficiently before a subsequent discharge is to take place.

With respect to this, in this example, the drive signal output section 20 as aforementioned further outputs the post-discharge controlling signal that is the signal for suppressing the liquid surface vibration of the ink after the discharge, in addition to the discharge driving signal. Further, more specifically, the post-discharge controlling signal is for example a signal that displaces the piezoelectric elements 208 so as to move the liquid surface in the direction opposite the movement of the liquid surface of the ink in the meniscus vibration. Due to this, the post-discharge controlling signal displaces the piezoelectric elements 208 in the direction that suppresses the meniscus vibration.

By configuring as above, for example, the meniscus vibration can be suppressed appropriately after the discharge of the ink droplets. Further, due to this, for example, the influence of the meniscus vibration generated by the ink droplets in each occasion being imposed on the operation to discharge the ink droplets taking place thereafter can appropriately be prevented. Further, in this case, since it becomes possible to shorten time needed before the meniscus vibration is settled, a discharge interval of the ink droplets can be made shorter. Due to this, for example, since a moving speed of the ink jet heads 12 upon the main scan operation can be made fast, even faster printing can be performed. Further, for example, by appropriately suppressing the meniscus vibration, generation of the ink mist and the like can appropriately be suppressed.

Further, in this example, the drive signal output section 20 outputs, as the post-discharge controlling signal, a signal of a substantial sine wave. By configuring as above, for example, upon suppression of the meniscus vibration, an abrupt displacement of the piezoelectric elements 208 can be prevented. Due to this, for example, an unintended vibration and the like being generated can be prevented, while the meniscus vibration can more appropriately be suppressed.

Note that, being a substantial sine wave in connection to the post-discharge controlling signal means for example, being substantially a sine wave in accordance with the accuracy and the like of a passage for transmitting the post-discharge controlling signal. Further, the post-discharge controlling signal being a substantial sine wave may mean for example being able to regard it as a sine wave, within a scope that can achieve the aim of preventing the generation of the unintended vibration and the like by inhibiting an abrupt displacement of the piezoelectric elements 208. For example, the post-discharge controlling signal may be a signal of which inclination gradually changes sequentially in the sine wave form. Further, the post-discharge controlling signal may for example be a signal containing the sine wave as its primary component. For example, the post-discharge controlling signal may be a signal and the like in which a predetermined direct current component and the like is superposed to a sine wave.

Further, in the present example, the drive signal output section 20 outputs, as the post-discharge controlling signal, a signal of a substantial sine wave having a same frequency as the meniscus vibration. In this case, the frequency of the meniscus vibration is for example a frequency corresponding to the natural vibration cycle Tc of the meniscus vibration. Further, in regards to the implementation, the frequencies of the post-discharge controlling signal and the meniscus vibration being the same for example may mean that a difference of these frequencies is within 20% or less, more preferably 10% or less of the frequencies.

Further, in a case of denoting a timing when the ink droplet is discharged from the nozzles 202 as a timing To, the drive signal output section 20 outputs the post-discharge controlling signal at least after the timing To and at least partially during a period until a time Tc/4 is elapsed. In this case, the drive signal output section 20 preferably outputs the post-discharge controlling signal at the same time as the timing To, or from immediately after the timing To. For example, in the depicted case, the drive signal output section 20 outputs the post-discharge controlling signal from the timing Td when only the time Tc that is 0 or more and less than (1/4)Tc has elapsed from To. Further, in this case, the drive signal output section 20 may output the post-discharge controlling signal during only a partial period within a waveform shown for example in the drawing. In this case, the drive signal output section 20 preferably outputs the post-discharge controlling signal at least in a period until Tc/4 from the timing To. For example, the drive signal output section may output the post-discharge controlling signal at the same time as the timing To, or from immediately after the timing To during the period until Tc/4 from the timing To.

Further, the drive signal output section 20 may output the post-discharge controlling signal over a time period encompassing plural cycles of the meniscus vibration or more. In this case, as the post-discharge controlling signal, for example, a signal of a substantial sine wave of which amplitude gradually decreases while vibrating in a sine wave form as shown in the drawing is preferably used. By configuring as above, the post-discharge controlling signal can be changed more appropriately together with the amplitude of the meniscus vibration becoming gradually small. By configuring as above, for example, the meniscus vibration can be suppressed more appropriately after the discharge of the ink droplets.

Further, for example, at the timing To of the discharge and thereafter, the drive signal output section 20 may output a signal of a complex wave in which the post-discharge controlling signal and another sine wave are superposed. In this case, the other sine wave may be a signal with a frequency different from the post-discharge controlling signal. By configuring as above, for example, the meniscus vibration can be suppressed more appropriately after the discharge of the ink droplets. Note that, as such a complex wave, for example, a signal of a complex wave that takes into consideration even a vibration mode of the meniscus vibration in a higher degree and the like may be used. Further, as such a complex wave, a signal and the like in which a signal other than a sine wave is superposed with the post-discharge controlling signal may be used.

As above, in this example, the drive signal output section 20 outputs the signal by which the voltage changes linearly as the discharge driving signal, and outputs the signal of a substantial sine wave as the post-discharge controlling signal. Further, due to this, the ink droplets can be discharged more appropriately from the nozzles 202 of the ink jet head with even higher accuracy. Thus, herein below, this point will be described in further detail.

To cause the ink droplets to strike onto the medium with high accuracy in the ink jet printer, the discharging speed by which the ink droplets are discharged from the nozzles 202 needs to be made sufficiently fast. Further, to obtain this, it becomes necessary to quickly displace the piezoelectric elements 208 at the timing when the ink droplets are discharged from the nozzles 202.

With respect to this, according to the present example, for example, the piezoelectric elements 208 can quickly and appropriately be displaced at the timing when the ink droplets are discharged from the nozzles 202 by using the signal by which the voltage changes linearly as the discharge driving signal. Further, due to this, for example, the discharging speed of the ink droplets can be made optimized and sufficiently fast.

On the other hand, in connection to the post-discharge controlling signal, to suppress the meniscus vibration, it is desirable not to newly generate unnecessary vibration and the like by adding the signal. With respect to this, according to the present example, as above, the unintended vibration and the like being generated is prevented and the meniscus vibration can more appropriately be suppressed by using the post-discharge controlling signal of a substantial sine wave.

Thus, according to the present example, for example, the piezoelectric elements 208 can be driven more appropriately for both upon discharging the ink droplets from the nozzles 202 and upon controlling the meniscus vibration thereafter. Further, due to this, for example, the ink droplets can be discharged more appropriately with even higher accuracy from the nozzles 202 of the ink jet head.

Note that, in the above, as the configuration of the ink jet heads 12, a configuration that provides one piezoelectric element 208 for one nozzle 202 was described. However, in a modification of the configuration of the ink jet heads 12, for example, a plurality of piezoelectric elements 208 may be provided for one nozzle 202. In this case, the ink jet heads 12 includes, as the piezoelectric elements 208 corresponding to the one nozzle 202, a first piezoelectric element that displaces in accordance with the discharge driving signal, and a second piezoelectric element being a piezoelectric element arranged separately from the first piezoelectric element, and that displaces in accordance with the post-discharge controlling signal.

In the case of configuring as above, for example, by using different piezoelectric elements dedicated to the discharge of the ink droplets and to the control of the meniscus vibration, the piezoelectric elements that are more suitable for each purpose can be used. More specifically, for example, piezoelectric elements having suitable size and shape for each purpose can be used. Further, the positions to provide the piezoelectric elements can be made to differ depending on the purposes. Due to this, by configuring as above, for example, the respective piezoelectric elements can be driven more appropriately for both upon discharging the ink droplets from the nozzle and upon controlling the meniscus vibration thereafter.

Further, as the discharge driving signal and the post-discharge controlling signal, for example, signals other than those shown in FIG. 3 may be used. Thus, herein below, various examples of the signals to be used as the discharge driving signal and the post-discharge controlling signal will be described.

Figure 4:
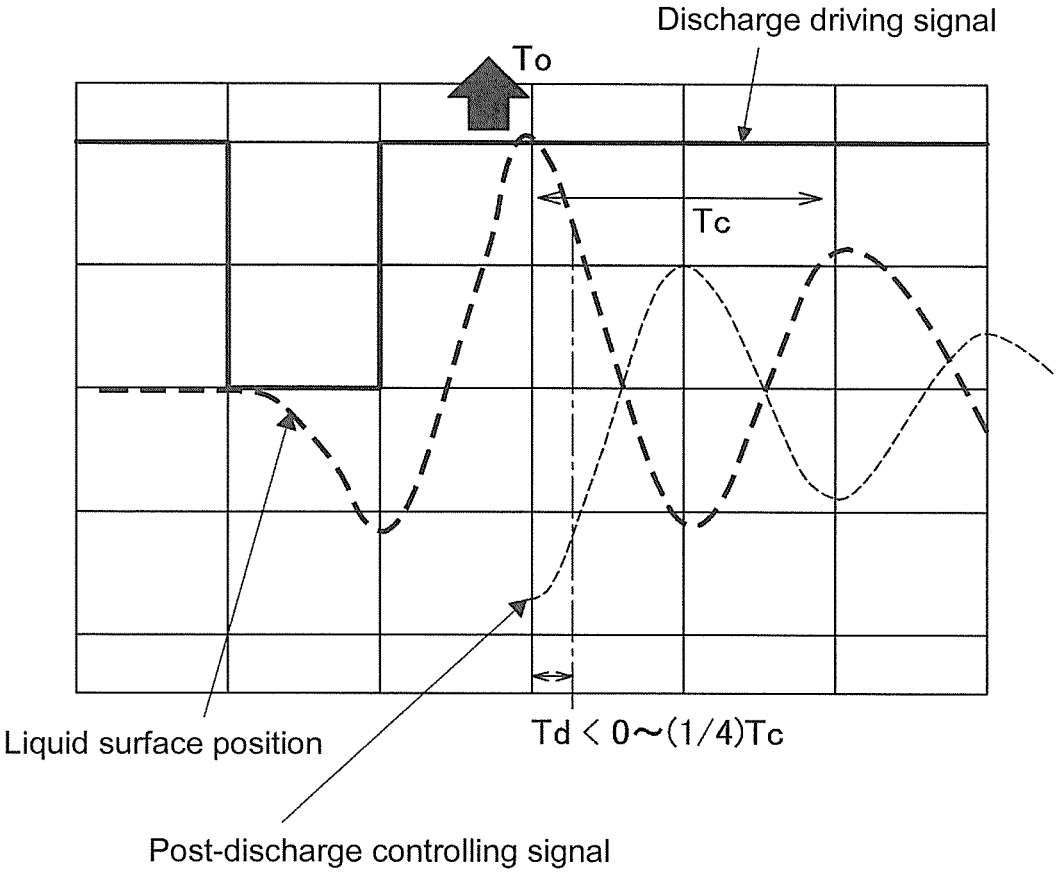
FIG. 4 is a graph showing another example of a discharge driving signal and a post-discharge controlling signal.

FIG. 4 is a graph showing another example of the discharge driving signal and the post-discharge controlling signal. Note that, aside from the points described herein below, the discharge driving signal and the post-discharge controlling signal shown in FIG. 4 have identical or similar characteristics as the discharge driving signal and the post-discharge controlling signal shown in FIG. 3.

In the case shown in FIG. 4, the drive signal output section 20 outputs a discharge driving signal by which the voltage changes so as to drop once before the timing of the discharge, and return to the original voltage thereafter. In this case, for example, the piezoelectric elements 208 are displaced at the timing when the voltage of the discharge driving signal drops so that the pressure in the ink chambers 204 drops. Further, due to this, the ink is drawn into the ink chambers 204 through the ink passages. Further, at the timing when the voltage of the discharge driving signal returns to the original voltage, the piezoelectric elements 208 increase the pressure in the ink chambers 204 by being displaced in the opposite direction. Further, due to this, the ink droplets are discharged from the nozzles 202. Due to this, by configuring as above, the ink droplets can appropriately be discharged from the nozzles 202 by a pull-push method that pushes out the ink after the ink is drawn into the ink chambers 204.

In this case as well, the piezoelectric elements 208 can quickly and appropriately be displaced at the timing when the ink droplets are discharged from the nozzles 202 by using the signal by which the voltage changes linearly as the discharge driving signal. Due to this, for example, the discharging speed of the ink droplets can be made optimized and sufficiently fast. Further, by outputting the post-discharge controlling signal of a substantial sine wave according to the timing of the change in the discharge driving signal, the meniscus vibration in the ink can be suppressed appropriately. Thus, in this case as well, the piezoelectric elements 208 can be driven more appropriately for both upon discharging the ink droplets from the nozzles 202 and upon controlling the meniscus vibration thereafter. Further, due to this, for example, the ink droplets can be discharged more appropriately with even higher accuracy from the nozzles 202 of the ink jet head.

Figure 5:
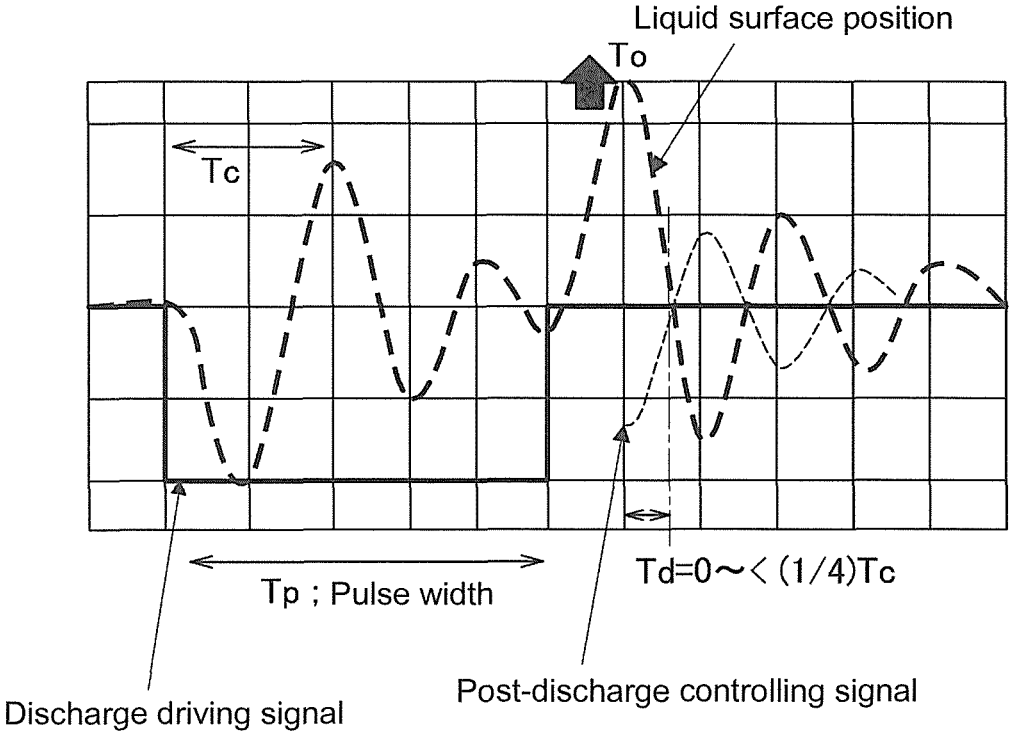
FIG. 5 is a graph showing yet another example of the discharge driving signal and the post-discharge controlling signal.

FIG. 5 is a graph showing yet another example of the discharge driving signal and the post-discharge controlling signal. Note that, aside from the points described herein below, the discharge driving signal and the post-discharge controlling signal shown in FIG. 5 have identical or similar characteristics as the discharge driving signal and the post-discharge controlling signal shown in FIG. 3 or 4.

In the example shown in FIG. 5, the drive signal output section 20 outputs a discharge driving signal having a pulse width Tp that is larger than the natural vibration cycle Tc of the meniscus vibration. In this case as well, for example, by using the discharge driving signal that changes as in the drawing, the ink droplets can appropriately be discharged from the nozzles 202.

Further, the piezoelectric elements 208 can quickly and appropriately be displaced at the timing when the ink droplets are discharged from the nozzles 202 by using the signal by which the voltage changes linearly as the discharge driving signal. Due to this, for example, the discharging speed of the ink droplets can be made optimized and sufficiently fast. Further, by outputting the post-discharge controlling signal of a substantial sine wave according to the timing of the change in the discharge driving signal, the meniscus vibration in the ink can be suppressed appropriately. Thus, in this case as well, the piezoelectric elements 208 can be driven more appropriately for both upon discharging the ink droplets from the nozzles 202 and upon controlling the meniscus vibration thereafter. Further, due to this, for example, the ink droplets can be discharged more appropriately with even higher accuracy from the nozzles 202 of the ink jet head.

Here, in FIGS. 3 to 5, examples for the case of using a signal of a rectangular wave is used as the discharge driving signal were described. However, as described earlier, other than the rectangular wave, for example, the trapezoidal wave form, or the sawtooth wave form and the like may be used as the discharge driving signal.

Figure 6:
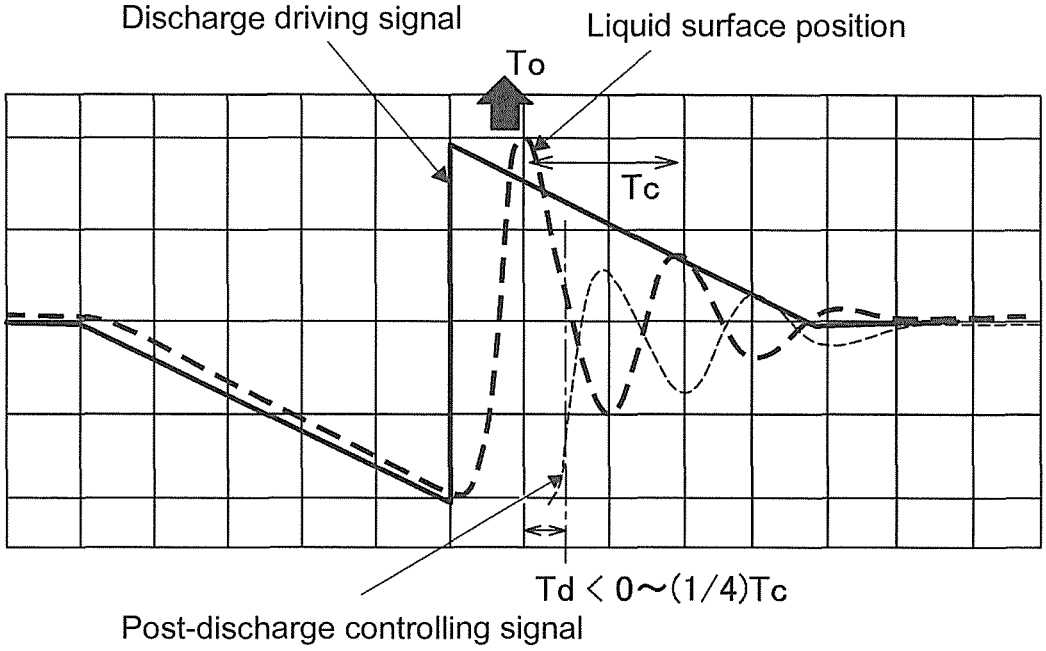
FIG. 6 is a graph showing yet another example of the discharge driving signal and the post-discharge controlling signal.

FIG. 6 is a graph showing yet another example of the discharge driving signal and the post-discharge controlling signal, and shows the example of the case of using a signal of the sawtooth wave form as the discharge driving signal. Note that, the signal of the sawtooth wave form is for example a signal having a sawtooth wave that changes similar to a rugged shape of a sawtooth. Further, aside from the points described herein below, the discharge driving signal and the post-discharge controlling signal shown in FIG. 6 have identical or similar characteristics as the discharge driving signal and the post-discharge controlling signal shown in FIGS. 3 to 5.

In this case as well, by displacing the piezoelectric elements 208 by the discharge driving signal that changes as in the drawing, the ink droplets can appropriately be discharged from the nozzles 202. Further, the piezoelectric elements 208 can quickly and appropriately be displaced at the timing when the ink droplets are discharged from the nozzles 202 by using the signal by which the voltage changes linearly as the discharge driving signal. Due to this, for example, the discharging speed of the ink droplets can be made optimized and sufficiently fast.

Further, in the case of using the sawtooth wave-formed discharge driving signal, the discharge driving signal changes for example significantly in a step shape only at the timing when the ink is pushed out. Due to this, the abrupt displacement is not generated in the piezoelectric elements 208 at timings other than the above. Thus, in the case of using the sawtooth wave-formed discharge driving signal, for example, the unnecessary vibration being generated in the meniscus can more appropriately be suppressed compared to the case of using the discharge driving signal of a rectangular wave.

Further, in this case as well, by outputting the post-discharge controlling signal of a substantial sine wave according to the timing of the change in the discharge driving signal, the meniscus vibration in the ink can be suppressed appropriately. Thus, in this case as well, the piezoelectric elements 208 can be driven more appropriately for both upon discharging the ink droplets from the nozzles 202 and upon controlling the meniscus vibration thereafter. Further, due to this, for example, the ink droplets can be discharged more appropriately with even higher accuracy from the nozzles 202 of the ink jet head.

Next, as to matters related to the meniscus vibration of the ink, supplemental description will be given. As described in the above as well, as the post-discharge controlling signal, it is preferable to output the signal of a substantial sine wave with the same frequency as the meniscus vibration. Further, the natural frequency of the meniscus vibration is determined for example in accordance with the volume V of the ink chambers 204, and the cross sectional area S of the nozzles 202.

However, the volume V of the ink chambers 204, and the cross sectional area S of the nozzles 202 may have some variation upon their manufacture. Due to this, even if logical values are calculated for example for the natural frequency and the natural cycle of the meniscus vibration, there are cases where a difference is present from the frequencies in the meniscus vibration generated in the actual print device 10.

Due to this, it is preferable to obtain the natural frequency and the like of the meniscus vibration, for example, by using the actual print device 10. More specifically, measurement of the frequency of the meniscus vibration is for example performed by using a laser Doppler vibroscope, a manometer, and the like, and thereby measuring vibration speed and vibration waveform of the meniscus vibration. In this case, as the laser Doppler vibroscope and the manometer, for example, known laser Doppler vibroscope or manometer can suitably be used. Further, more specifically, as the manometer, for example, Pressure Transmitter KL60, a digital differential pressure gauge GC62 and the like, all manufactured by Nagano Keiki Co., Ltd. can suitably be used. Further, in this measurement, for example, ink droplet discharge from the nozzles is caused by supplying predetermined pulse signals to the piezoelectric elements of the ink jet heads, and the waveform and the like generated in the meniscus vibration is measured by the laser Doppler vibroscope.

By measuring as above, for example, the natural frequency and the like of the meniscus vibration can appropriately be measured. Further, based on this measurement result, for example, a post-discharge controlling signal having an inversed phase relationship with the natural vibration of the meniscus vibration may be generated more appropriately in a signal generator using a DSP (Digital Signal Processor), for example.

Note that, the natural vibration cycle (Tc) of the meniscus vibration differs for example depending on the ink to be used. Due to this, for example, it is preferable that various types of ink are used in the ink jet heads in advance upon manufacturing the print device 10 and the like so as to obtain the natural frequency or the natural vibration cycle of the meniscus vibration corresponding to each ink. Due to this, the drive signal output section for example generates the post-discharge controlling signal based on the natural frequency and the like of the meniscus vibration. The drive signal output section may generate the post-discharge controlling signal based on a variable frequency of the ink pressure in the ink jet head. Further, in a case of a configuration capable of using plural types of ink, it is preferable to provide a function for changing the frequency of the post-discharge controlling signal according to the type of the ink to be used in the print device 10. The change in the frequency of the post-discharge controlling signal may be changed automatically according to the ink to be used, or may be changed manually by the user's operation. By configuring as above, for example, the control of the meniscus vibration can be performed more appropriately.

The present invention was described by using embodiments as above, however, the technical scope of the present invention is not limited to the above embodiments. It is apparent to those skilled in the art that various modifications and improvements can be made to the above embodiments. It is apparent from the description of the claims that embodiments in which such change or improvement have been made may also be included in the technical scope of the present invention.

INDUSTRIAL APPLICABILITY

The present invention can suitably be used for example in a print device.

REFERENCE SIGNS LIST

10 . . . Print device,
12 . . . Ink jet head,
14 . . . Main scan driving section,
16 . . . Sub scan driving section,
18 . . . Platen,
20 . . . Drive signal output section,
22 . . . Control section,
50 . . . Medium,
102 . . . Carriage,
104 . . . Guide rail,
202 . . . Nozzle,
204 . . . Ink chamber,
206 . . . Thin film,
208 . . . Piezoelectric element

What is claimed is:

1. A print device configured to perform printing by an ink jet scheme, the print device comprising:

an ink jet head including a nozzle that discharges ink droplets, an ink chamber that stores the ink droplets at an upstream of the nozzle, and a piezoelectric element that causes ink in the ink chamber to be discharged from the nozzle; and a drive signal output section that outputs a drive signal being a signal for causing the piezoelectric element to be displaced, wherein the drive signal is a signal that includes a discharge driving signal for causing the piezoelectric element to be displaced so that the ink droplets are discharged from the nozzle, and a post-discharge controlling signal for causing the piezoelectric element to be displaced so that a meniscus vibration in which a liquid surface of the ink vibrates at a position of the nozzle is settled after the ink droplets are discharged from the nozzle, wherein in a case of denoting a timing when the ink droplets are discharged from the nozzle as a timing To, and denoting a cycle of a natural vibration of a meniscus vibration in which a liquid surface of the ink vibrates at a position of the nozzle after the ink droplets are discharged as Tc, the drive signal output section is configured to:

output, as the discharge driving signal, a signal by which a voltage changes linearly from a first voltage to a second voltage, which are predeterminedly set, at a time period, which is earlier than the timing To, when the ink droplets are to be discharged from the nozzle, output, as the post-discharge controlling signal, a signal of a substantial sine wave having a cycle equal to the measured cycle Tc, at least after the timing To, and within a time Tc/4 from the timing To, such that the piezoelectric element is displaced in a direction along which the meniscus vibration at the position of the nozzle after the ink droplets are discharged is suppressed, wherein the post-discharge controlling signal has an inversed phase relationship with a natural vibration of the meniscus vibration.

2. The print device according to claim 1, wherein the discharge driving signal is a signal in a rectangular wave form, a trapezoidal wave form, or a sawtooth wave form.

3. A print method configured to perform printing by an ink jet scheme, the print method comprising:

outputting a drive signal being a signal for causing a piezoelectric element to be displaced to an ink jet head including a nozzle that discharges ink droplets, an ink chamber that stores the ink droplets at an upstream of the nozzle, and the piezoelectric element that causes an ink in the ink chamber to be discharged from the nozzle, wherein the drive signal is a signal that includes a discharge driving signal for causing the piezoelectric element to be displaced so that the ink droplets are discharged from the nozzle, and a post-discharge controlling signal for causing the piezoelectric element to be displaced so that a meniscus vibration in which a liquid surface of the ink vibrates at a position of the nozzle is settled after the ink droplets are discharged from the nozzle, wherein in a case of denoting a timing when the ink droplets are discharged from the nozzle as a timing To, and denoting a cycle of a natural vibration of a meniscus vibration in which a liquid surface of the ink vibrates at a position of the nozzle after the ink droplets are discharged as Tc;

outputting, as the discharge driving signal, a signal by which a voltage changes linearly from a first voltage to a second voltage, which are predeterminedly set, at a time period, which is earlier than the timing To, when the ink droplets are to be discharged from the nozzle;

outputting, as the post-discharge controlling signal, a signal of a substantial sine wave having a cycle equal to the measured cycle Tc, at least after the timing To, and within a time Tc/4 from the timing To, such that the piezoelectric element is displaced in a direction along which the meniscus vibration at the position of the nozzle after the ink droplets are discharged is suppressed, wherein the post-discharge controlling signal has an inversed phase relationship with a natural vibration of the meniscus vibration.

* * * * *